US008400380B2

(12) United States Patent
Lee

(10) Patent No.: US 8,400,380 B2
(45) Date of Patent: Mar. 19, 2013

(54) ORGANIC LIGHT EMITTING DISPLAY DEVICE AND DRIVING METHOD THEREOF

(75) Inventor: An-Su Lee, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 355 days.

(21) Appl. No.: 12/760,512

(22) Filed: Apr. 14, 2010

(65) Prior Publication Data

US 2011/0050740 A1 Mar. 3, 2011

(30) Foreign Application Priority Data

Sep. 2, 2009 (KR) ..... 10-2009-0082450

(51) Int. Cl.
*G09G 3/30* (2006.01)

(52) U.S. Cl. ..... 345/77; 345/83

(58) Field of Classification Search ..... 345/76–77, 345/82, 690

See application file for complete search history.

(56) References Cited

U.S. PATENT DOCUMENTS

| | | | | |
|---|---|---|---|---|
| 7,382,341 | B2 * | 6/2008 | Park | 345/77 |
| 7,755,580 | B2 * | 7/2010 | Mas et al. | 345/82 |
| 7,876,292 | B2 * | 1/2011 | Cho et al. | 345/76 |
| 8,184,074 | B2 * | 5/2012 | Park et al. | 345/76 |
| 2006/0170625 | A1 * | 8/2006 | Kim | 345/76 |
| 2008/0012804 | A1 * | 1/2008 | Kim et al. | 345/82 |

FOREIGN PATENT DOCUMENTS

| | | |
|---|---|---|
| KR | 1020060020502 A | 3/2006 |
| KR | 10-0739334 | 7/2007 |
| KR | 10-2008-0034573 | 4/2008 |
| KR | 1020080044104 A | 5/2008 |
| KR | 10-2008-0088701 | 10/2008 |

OTHER PUBLICATIONS

KIPO Office Action dated Mar. 17, 2011 for Korean priority patent application 10-2009-0082450, noting listed references in this IDS.

* cited by examiner

*Primary Examiner* — Chanh Nguyen
*Assistant Examiner* — Roy Rabindranath
(74) *Attorney, Agent, or Firm* — Christie, Parker & Hale, LLP

(57) ABSTRACT

An organic light emitting display device includes a scan driver for driving scan lines and light emitting control lines; a data driver for selecting any one gamma voltage of a plurality of gamma voltages corresponding to bit values of externally supplied data and generating data signals; a pixel coupled to a reference power, a first power, and a second power, and the pixel configured to compensate for a voltage drop of the first power using the reference power; and a gamma voltage controller for comparing a voltage value of the reference power with that of a comparative power having a target voltage value of the reference power to generate a comparison result and controlling voltage value of the gamma voltages in accordance with the comparison result.

8 Claims, 4 Drawing Sheets

ORGANIC LIGHT EMITTING DISPLAY DEVICE AND DRIVING METHOD THEREOF

CROSS-REFERENCE TO RELATED APPLICATION

This application claims priority to and the benefit of Korean Patent Application No. 10-2009-0082450, filed on Sep. 2, 2009, in the Korean Intellectual Property Office, the entire content of which is incorporated herein by reference.

BACKGROUND

1. Field

An aspect of the embodiments of the present invention relates to an organic light emitting display device and a driving method thereof.

2. Description of Related Art

Recently, various flat panel displays with reduced weight and volume in comparison to a cathode ray tube have been developed. The flat panel displays include a liquid crystal display device, a field emission display device, a plasma display panel, an organic light emitting display device, etc.

The organic light emitting display device displays an image using organic light emitting diodes that emit light by a re-combination of electrons and holes. Such an organic light emitting display device has a rapid response speed and low power consumption.

FIG. 1 is a circuit diagram showing a pixel of a conventional organic light emitting display device.

Referring to FIG. 1, a pixel 4 of the conventional organic light emitting display includes an organic light emitting diode (OLED), and a pixel circuit 2 that is coupled to a data line Dm and a scan line Sn to control the OLED.

The anode electrode of the OLED is coupled to the pixel circuit 2, and the cathode electrode of the OLED is coupled to a second power supply ELVSS. The OLED generates light having a brightness (e.g., a predetermined brightness) corresponding to the amount of current supplied from the pixel circuit 2.

The pixel circuit 2 controls the amount of current supplied to the OLED corresponding to a data signal supplied from a data line Dm when a scan signal is supplied to a scan line Sn. To this end, the pixel circuit 2 includes a second transistor M2 coupled to a first power supply ELVDD and the OLED, a first transistor M1 coupled to the data line Dm and the scan line Sn, and a storage capacitor Cst coupled between the gate electrode and the first electrode of the second transistor M2.

The gate electrode of the first transistor M1 is coupled to the scan line Sn, the first electrode of the first transistor M1 is coupled to the data line Dm. The second electrode of the first transistor M1 is coupled to one terminal of the storage capacitor Cst. Here, the first electrode may be one of a source electrode and a drain electrode, and the second electrode is an electrode other than the first electrode. For example, if the first electrode is a source electrode, the second electrode is a drain electrode. The first transistor M1, which is coupled to the scan line Sn and the data line Dm, is turned on when the scan signal is supplied from the scan line Sn to supply the data signal supplied from the data line DM to the storage capacitor Cst. Here, the storage capacitor Cst is charged with a voltage corresponding to the data signal.

The gate electrode of the second transistor M2 is coupled to one terminal of the storage capacitor Cst, and the first electrode of the second transistor M2 is coupled to the other terminal of the storage capacitor Cst and the first power supply ELVDD. The second electrode of the second transistor M2 is coupled to the anode electrode of the OLED. The second transistor M2 controls the amount of current flowing to the second power supply ELVSS from the first power supply ELVDD via the OLED in accordance with the voltage value stored in the storage capacitor Cst. Here, the OLED generates light corresponding to the amount of current supplied from the second transistor M2.

However, the conventional organic light emitting display device as described above has a problem that the voltage value of the first power supply ELVDD varies according to the position of the pixel 2 within the display device due to voltage drop, thereby causing a problem that an image having a desired brightness cannot be displayed.

There has been proposed a method to charge the storage capacitor Cst using a separate reference power supply irrespective of the first power supply ELVDD. The reference power supply does not supply current to the organic light emitting display device, thereby not generating voltage drop. However, when the above described pixel 2 is charged with a voltage using the reference power supply, a problem arises in that the display quality of the entire display panel is deteriorated (for example, generation of spots on the panel) when the voltage of the reference power supply is changed due to external effects.

SUMMARY

Aspects of the embodiments of the present invention relate to an organic light emitting display device with improved display quality and a driving method thereof.

According to one embodiment, an organic light emitting display device includes: a scan driver for driving scan lines and light emitting control lines; a data driver for selecting any one gamma voltage of a plurality of gamma voltages corresponding to bit values of externally supplied data and generating data signals; a pixel coupled to a reference power, a first power, and a second power, the pixel configured to compensate for a voltage drop of the first power using the reference power; and a gamma voltage controller for comparing a voltage value of the reference power with that of a comparative power having a target voltage value of the reference power to generate a comparison result and controlling voltage values of the gamma voltages in accordance with the comparison result.

Exemplarily, the gamma voltage controller may be configured to control the voltage values of the gamma voltages so that a voltage variation of the reference power supply is compensated for in accordance with a voltage difference between the reference power and the comparative power. The gamma voltage controller may includes: a gamma unit for generating the gamma voltages; at least one comparator for comparing the voltage of the reference power supply with that of the comparative power supply; a subtractor for obtaining a voltage difference between the reference power and the comparative power in accordance with a comparison result of the at least one comparator; and a controller for controlling the gamma unit in accordance with the comparison result of the at least one comparator and the voltage difference. The comparator may includes: a first comparator for generating a first control signal when the voltage of the reference power supply is higher than the voltage of the comparative power supply, and generating a second control signal when the voltage of the reference power supply is lower than the voltage of the comparative power supply; and a second comparator for generating a third control signal when the voltage of the reference power supply is the same as that of the comparative power supply. The controller may be configured to control the gamma unit so that the voltages of the gamma voltages is not changed when the third control signal is input. The controller may be configured to control the gamma unit to output the gamma voltages that compensate for the voltage variation of the reference power supply in accordance with the voltage difference when the first control signal or the second control signal is input. The organic light emitting display device may further include: an analog-digital converter positioned between the subtractor and the controller and configured to convert an analog signal corresponding to the voltage difference supplied from the subtractor into a digital signal and to transfer it to the controller.

According to another embodiment, there is provided a driving method of an organic light emitting display device including a pixel coupled to a first power supply, a second power supply and a reference power, the method including: while controlling an amount of current supplied to the second power supply from the first power supply when the pixel emits light, compensating for a voltage drop of the first power supply using the reference power, including: comparing a voltage of the reference power supply with that of a comparative power supply having a target voltage value of the reference power supply; and resetting gamma voltages corresponding to a voltage variation of the reference power supply in accordance with the comparison result.

Exemplarily, the resetting the gamma voltages may include setting the voltage values of the gamma voltages so that the voltage variation of the reference power supply is compensated for. The driving method of the organic light emitting display device may further include: selecting any one of the gamma voltages in accordance with externally supplied data to generate a data signal; and supplying the data signal to the pixel.

According to another embodiment of the present invention, an organic light emitting display device includes: a scan driver for driving scan lines and light emitting control lines; a data driver for driving data lines with data in accordance with selected gamma voltages; a pixel for receiving a reference power, a first power, and a second power, the pixel configured to compensate for a voltage drop of the first power using the reference power; and a gamma voltage controller for controlling voltage values of the gamma voltages in accordance with a voltage variation of the reference power from a target voltage.

With the organic light emitting display device and the driving method thereof according to the embodiments as described above, the image having the desired brightness may be displayed on the pixel by controlling the gamma voltages although the voltage value of the reference power supply is changed due to the external environment. Therefore, the embodiments may display the image having the desired brightness irrespective of the voltage variation of the reference power supply, thereby making it possible to improve display quality.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
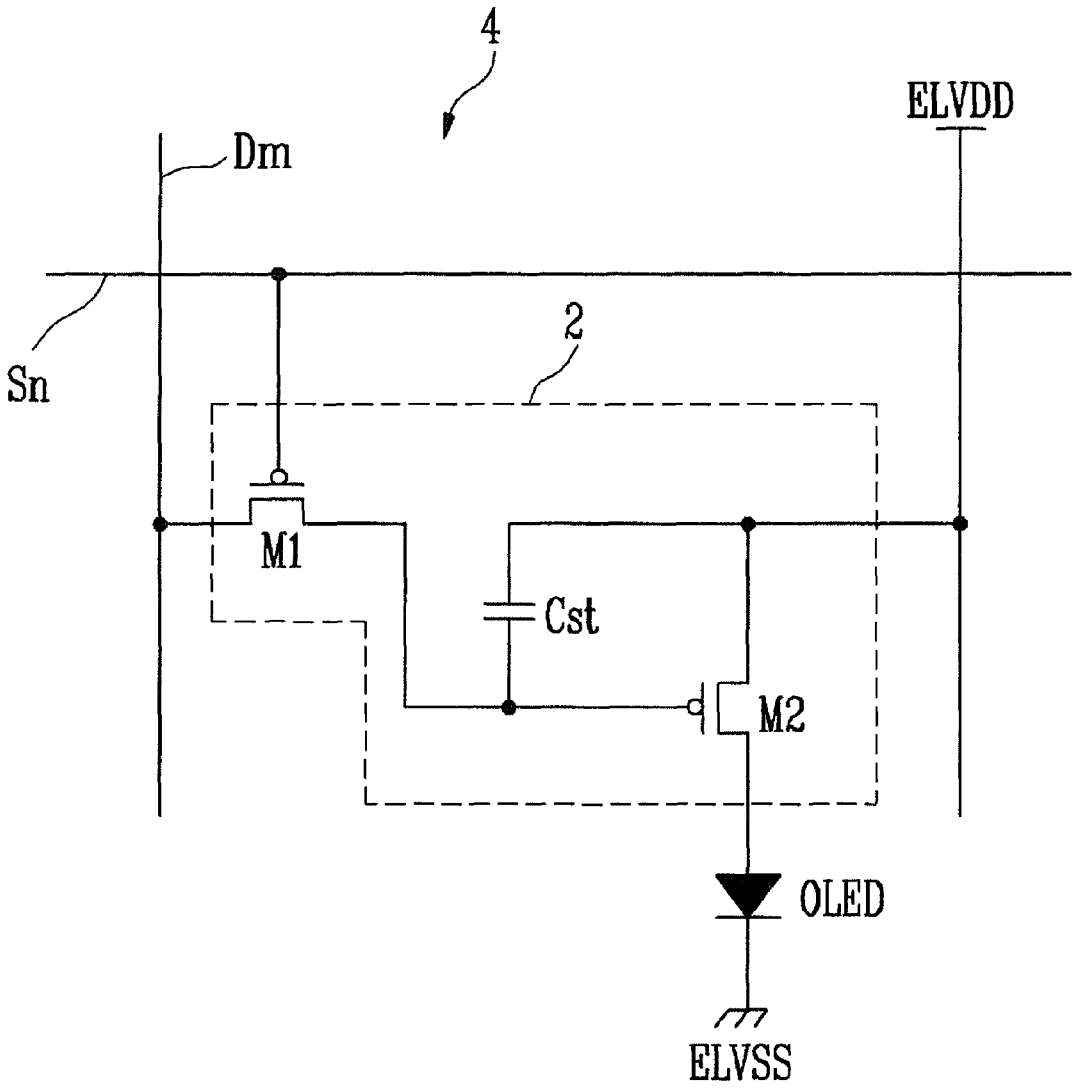
FIG. 1 (RELATED ART)
FIG. 1 is a circuit diagram showing a pixel of a conventional organic light emitting display device.

Hereinafter, certain exemplary embodiments according to the present invention will be described with reference to the accompanying drawings. Here, when a first element is described as being coupled to a second element, the first element may be directly coupled to the second element or indirectly coupled to the second element via a third element. Further, some of the elements that are not essential to a complete understanding of the invention are omitted for clarity. Also, like reference numerals refer to like elements throughout.

Hereinafter, exemplary embodiments of the present invention will be described in more detail with reference to the accompanying FIGS. 2 to 6.

Figure 2:
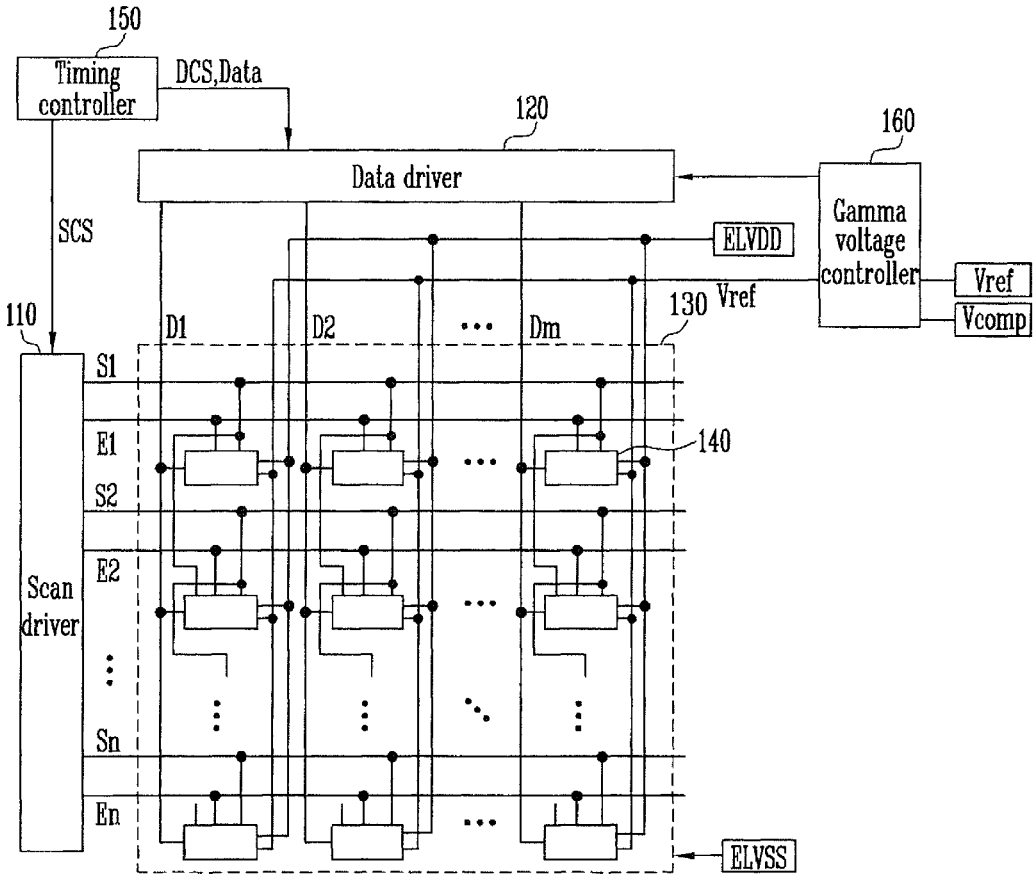
FIG. 2 is a circuit diagram of an organic light emitting display device according to an embodiment of the present invention.

FIG. 2 is a circuit diagram of an organic light emitting display device according to one embodiment of the present invention.

Referring to FIG. 2, the organic light emitting display device according to one embodiment of the present invention includes a display unit 130 including a plurality of pixels 140 that are coupled to scan lines S1 to Sn, light emitting control lines E1 to En, and data lines D1 to Dm, a scan driver 110 that drives the scan lines S1 to Sn and the light emitting control lines E1 to En, a data driver 120 that drives the data lines D1 to Dm, a timing controller 150 that controls the scan driver 110 and the data driver 120, a gamma voltage controller 160 that compares the voltage value of a reference power supply Vref and that of a comparative power supply Vcomp and controls gamma voltage corresponding to the comparison result.

The pixels 140 are formed on the region partitioned by the scan lines 51 to Sn, the light emitting control lines E1 to En, and the data lines D1 to Dm. The pixels 140 receive first power ELVDD, second power ELVSS, and reference power Vref from the outside of the display unit 130. Each of the pixels 140 that receives the reference power Vref compensates for the voltage drop of the first power supply ELVDD and the threshold voltage of a driving transistor using a value of voltage difference between the reference power Vref and the first power ELVDD.

The pixels 140 supply a predetermined current to the second power supply ELVSS from the first power supply via an OLED included in each of the pixels 140 in accordance with the data signals supplied to the pixels 140. Then, the light having a brightness (e.g., a predetermined brightness) is generated from the OLED.

Here, the constitution of the pixels 140 may be constituted in various suitable circuits for compensating for the voltage drop of the first power supply using the reference power Vref. In other words, the pixels 140 may be constituted in currently well-known suitable circuits including the reference power supply Vref.

The timing controller 150 generates a data driving control signal DCS and a scan driving control signal SCS corresponding to the synchronization signal supplied from the outside. The data driving control signal DCS generated from the timing controller 150 is supplied to the data driver 120, and the scan driving control signal SCS is supplied to the scan driver 110. The timing controller 150 supplies the externally supplied data Data to the data driver 120.

The scan driver 110 receives the scan driving control signal SCS. The scan driver 110 that received the scan driving control signal SCS supplies scan signals sequentially to the scan lines S1 to Sn. In addition, the scan driver 110 that received the scan driving control signal SCS supplies light emitting control signals sequentially to the light emitting control lines E1 to En. Here, the light emitting control signals are supplied to be overlapped with two scan signals in at least a partial period. To this end, the width of the light emitting control signal is set to be equal to or broader than the width of the scan signal.

The gamma voltage controller 160 compares the reference power Vref with the comparative power Vcomp and controls the gamma voltage corresponding to the comparison result. Here, the comparative power Vcomp is set to a target voltage value that the reference voltage Vref is to be set, irrespective of the external effect. To this end, the comparative power Vcomp may be generated from a separate power supply unit different from the reference power supply Vref.

The gamma voltage controller 160 determines the voltage difference between the reference power Vref and the comparative power Vcomp, and changes the gamma voltage to correspond to the voltage difference. Here, the changed gamma voltage is set so that an image having a desired brightness can be displayed, irrespective of the voltage change of the reference power supply Vref.

The data driver 120 receives a data driving control signal DCS from the timing controller 150. The data driver 120 that received the data driving control signal DCS selects the gamma voltages corresponding to the bit values of the data Data, and supplies the selected gamma voltages to the data lines D1 to Dm as the data signals.

Figure 3:
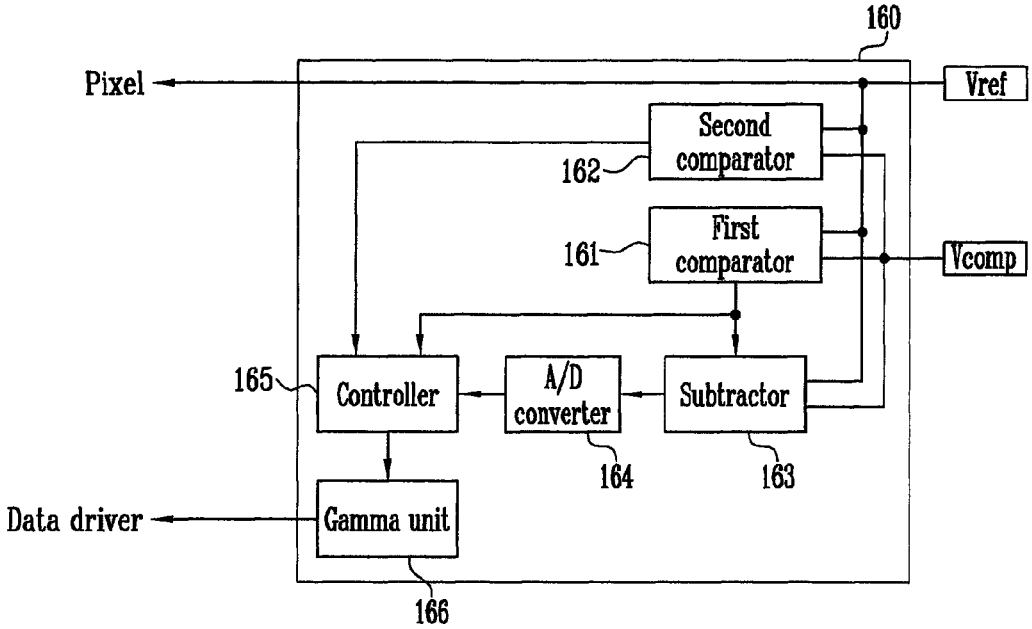
FIG. 3 is a block diagram showing the gamma voltage controller of FIG. 2.

FIG. 3 is a block diagram showing the gamma voltage controller of FIG. 2 according to one embodiment of the present invention.

Referring to FIG. 3, the gamma voltage controller 160 according to the embodiment of the present invention includes a first comparator 161, a second comparator 162, a subtractor 163, an analog-digital converter (hereinafter, referred to as "A/D converter") 164, a controller 165, and a gamma unit 166.

The first comparator 161 compares the voltage value of the reference power supply Vref with that of the comparative power supply Vcomp, and generates a first control signal or a second control signal corresponding to the comparison result. For example, when the voltage of the reference power supply Vref is large, the first comparator 161 generates the first control signal, and when the voltage of the comparative power supply Vcomp is large, the first comparator 161 generates the second control signal. The first control signal or the second control signal generated from the first comparator 161 is supplied to the subtractor 163 and the controller 165.

The second comparator 162 compares the voltage value of the reference power supply Vref with that of the comparative power supply Vcomp, and generates a third control signal when the voltage value of the reference power supply Vref is the same as that of the comparative power supply Vcomp. The third control signal generated from the second comparator 162 is supplied to the controller 165.

The subtractor 163 calculates the voltage difference between the reference power supply Vref and the comparative power supply Vcomp, and supplies an analog signal corresponding to the calculated voltage difference to the A/D converter 164.

The A/D converter 164 converts the analog signal supplied from the subtractor 163 into a digital signal, and supplies the converted digital signal to the controller 165.

When the third control signal is supplied from the second comparator 162 (i.e., when the voltage of the reference power supply Vref is not changed), the controller 165 controls the gamma voltage of the gamma unit 166 to be output having the value as originally set. Here, when the first control signal is input, the controller 165 controls the gamma voltage so that the voltage raise (i.e., the voltage difference) of the reference power supply Vref is compensated for by using the voltage difference supplied from the ND converter 164. Also, when the second control signal is input, the controller 165 controls the gamma voltage so that the voltage drop (i.e., the voltage difference) of the reference power supply Vref is compensated for by using the voltage difference supplied from the A/D converter 164.

For example, when the first control signal is input, the controller 165 may set the voltage of the gamma voltage so that the brightness is lowered corresponding to the voltage difference supplied from the A/D converter 164. When the second control signal is input, the controller 165 may set the voltage of the gamma voltage so that the brightness is increased corresponding to the voltage difference supplied from the ND converter 164.

According to one embodiment, the gamma unit 166 has a plurality of resistor strings in order to generate a plurality of gamma voltages. Such a gamma unit 166 converts the voltage value of the gamma voltages without the controller 165, and supplies the gamma voltages whose voltage values are changed to the data driver 120.

The above operation process is described in more detail below in reference to FIGS. 2 and 3. First, the first comparator 161 and the second comparator 162 compare the voltage of the reference power supply Vref with that of the comparative power supply Vcomp, and supply the control signals corresponding to the compared voltages to the controller 165 and/or the subtractor 163.

Here, upon determining that the voltage of the reference power supply Vref is the same as that of the comparative power supply Vcomp, the third control signal is generated from the second comparator 162 to be supplied to the controller 165. The controller 165 that received the third control signal controls the gamma unit 166 so that the originally set voltage value is to be maintained.

Thereafter, the pixels 140 are selected in a horizontal line unit (i.e., line-by-line) by the scan signals supplied sequentially from the scan driver 110. Here, the data driver generates the data signals corresponding to the bits of the data Data using the gamma voltages supplied from the gamma unit 166, and supplies the generated data signals to the pixels 140 selected by the scan signals. The pixels 140 that received the data signals generate light having a brightness (e.g., a predetermined brightness) corresponding to the data signals.

Here, upon determining that the voltage of the reference power supply Vref is different from that of the comparative power supply Vcomp, the first control signal or the second control signal is generated from the first comparator 161 to be supplied to the subtractor 163 and the controller 165. The subtractor that received the first control signal or the second control signal subtracts a lower voltage from a higher voltage to obtain a voltage difference, and supplies the analog signal corresponding to the voltage difference to the A/D converter 164. The A/D converter 164 converts the analog signal into a digital signal to supply it to the controller 165.

The controller 165 that received the first control signal or the second control signal and the digital signal controls the gamma unit 166 so that the voltage difference included in the digital signal can be compensated for. In other words, the controller 165 controls the gamma unit 166 so that an image having a desired brightness can be displayed on the pixels, irrespective of the voltage change in the reference power supply Vref. The gamma unit 166 changes the voltage value of the gamma voltages corresponding to the control of the controller 165, and supplies the changed gamma voltages to the data driver 120.

Thereafter, the pixels 140 are selected in a horizontal line unit by the scan signals supplied sequentially from the scan driver 110. Here, the data driver 120 generates the data signals corresponding to the bits of the data Data using the gamma voltages supplied from the gamma unit 166, and supplies the generated data signals to the pixels 140 selected by the scan signals. The pixels 140 that received the data signals generate light having a brightness (e.g., a predetermined brightness) corresponding to the data signals.

As described above, the gamma voltage controller 160 extracts the differential voltage between the reference power supply Vref and the comparative power supply Vcomp, and changes the voltage value of the gamma voltages so that an image having a desired brightness can be displayed irrespective of the voltage variation of the reference power supply Vref. Therefore, in the above described embodiment, image having the desired brightness can be displayed even though the voltage of the reference power supply Vref is changed due to the effects of the external environment.

Figure 4:
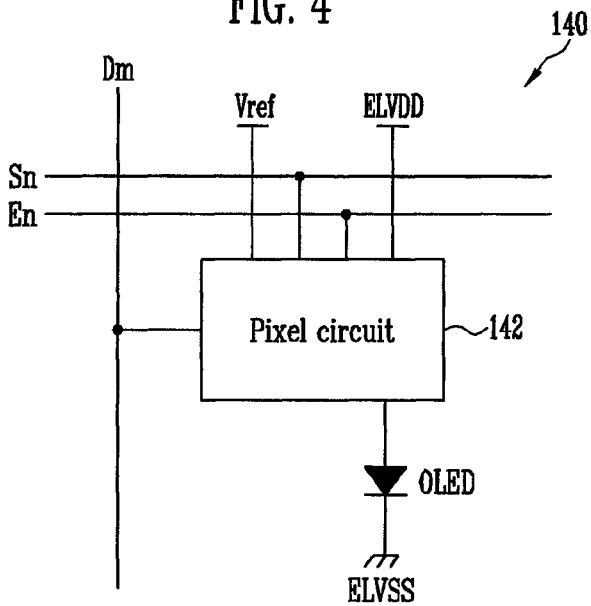
FIG. 4 is a circuit diagram of a pixel according to an embodiment of the present invention.

FIG. 4 is a circuit diagram of a pixel according to an embodiment of the present invention. For the convenience of explanation, a pixel coupled to an n-th scan line Sn and an m-th data line Dm will be shown in FIG. 4.

Referring to FIG. 4, the pixel 140 according to one embodiment of the present invention includes an organic light emitting diode OLED and a pixel circuit 142 that supplies current to OLED.

The OLED generates light having a color (e.g., a predetermined color) corresponding to the current supplied from the pixel circuit 142. For example, the OLED generates red, green, or blue light having a brightness (e.g., a predetermined brightness) corresponding to the amount of current supplied from the pixel circuit 142.

The pixel circuit 142 is coupled to at least one scan line Sn, one data line Dm, and one light emitting control line En, and receives the reference power Vref and first power ELVDD from the outside. The pixel circuit 142 supplies the current corresponding to the data signal to the OLED, irrespective of the voltage drop of the first power ELVDD and the threshold voltage of a driving transistor. Here, the pixel circuit 142 may have various suitable circuit constitutions and receives the reference power Vref and the first power ELVDD.

Figure 5:
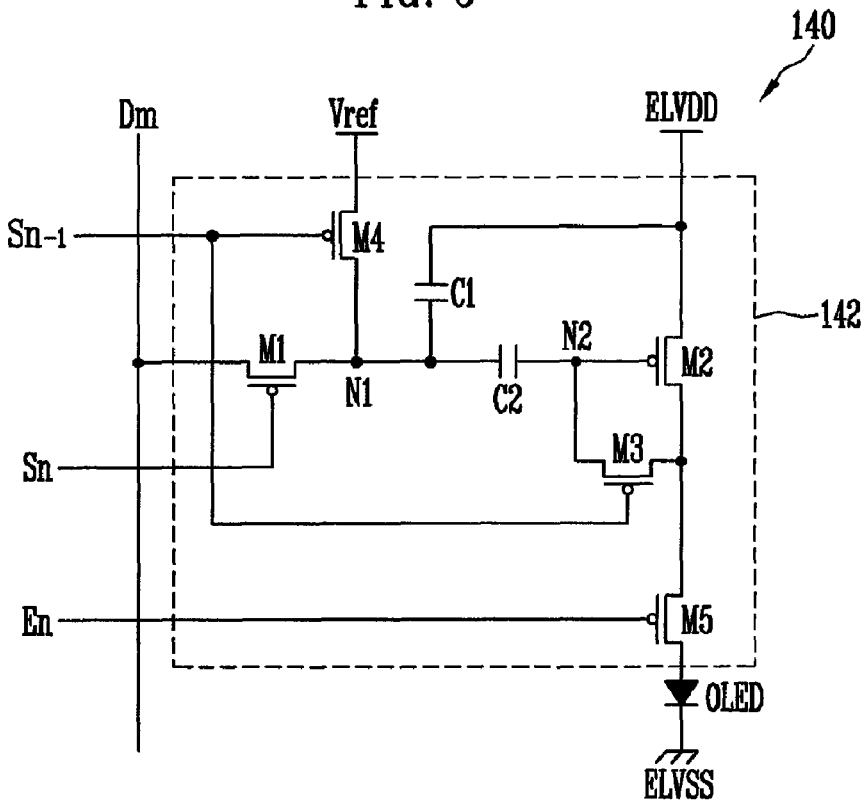
FIG. 5 is a circuit diagram showing the detailed circuit of the pixel of FIG. 4 according to an embodiment of the present invention.

FIG. 5 is a circuit diagram showing one embodiment of the pixel circuit of FIG. 4.

Referring to FIG. 5, the pixel circuit 142 according to one embodiment of the present invention includes first to fifth transistors M1 to M5, a first capacitor C1 and a second capacitor C2.

The first electrode of the first transistor M1 is coupled to a data line Dm and the second electrode of the first transistor M1 is coupled to a first node N1. The gate electrode of the first transistor M1 is coupled to an n-th scan lines Sn. When a scan signal is supplied to the n-th scan line Sn, the first transistor M1 is turned on to electrically connect the data line Dm to the first node N1.

The first electrode of the second transistor M2 is coupled to a first power supply ELVDD and the second electrode of the second transistor M2 is coupled to the first electrode of the fifth transistor M5. The gate electrode of the second transistor M2 is coupled to a second node N2. The second transistor M2 supplies the current corresponding to the voltage charged in the first capacitor C1 and the second capacitor C2, which is the voltage applied to the second node N2, to the first electrode of the fifth transistor M5.

The second electrode of the third transistor M3 is coupled to the second node N2, and the first electrode of the transistor M3 is coupled to the second electrode of the second transistor M2. The gate electrode of the third transistor M3 is coupled to an (n−1)th scan line Sn−1. When the scan signal is supplied to the (n−1)th scan line Sn−1, the third transistor M3 is turned on to connect the second transistor in a diode configuration (i.e., diode-connected).

The first electrode of the fourth transistor M4 is coupled to a reference power supply Vref, and the second electrode of the fourth transistor M4 is coupled to the first node N1. The gate electrode of the fourth transistor M4 is coupled to the (n−1)th scan line Sn−1. When the scan signal is supplied to the (n−1) th scan line Sn−1, the fourth transistor M4 is turned on to electrically connect the reference power supply Vref to the first node N1.

The first electrode of the fifth transistor M5 is coupled to the second electrode of the second transistor M2, and the second electrode of the fifth transistor M5 is coupled to the anode electrode of an organic light emitting diode OLED. The gate electrode of the fifth transistor M5 is coupled to an n-th light emitting control line En. When a light emitting control signal is supplied to the n-th light emitting control line En, the fifth transistor M5 is turned off, and when the light emitting control signal is not supplied to the n-th light emitting control line En, the fifth transistor M5 is turned on. Here, the light emitting control signal supplied to the n-th light emitting control line En is supplied to be partially overlapped with the scan signal supplied to the (n−1)th scan line Sn−1 and to be completely overlapped with the scan line supplied to the n-th scan line Sn. Therefore, the fifth transistor M5 is turned off during the period when a voltage (e.g., a predetermined voltage) is charged in the first capacitor C1 and the second capacitor C2, and the fifth transistor M5 electrically connects the second transistor M2 to the OLED during periods other than the above described period.

Here, the first power supply ELVDD is coupled to each of the pixels 140 to supply a current (e.g., a predetermined current), thereby generating different voltage drop according to the positions of the pixels 140. However, the reference power supply Vref does not supply current to each of the pixels 140, thereby making it possible to maintain the same voltage value irrespective of the positions of the pixels 140. Here, the voltage values of the first power supply ELVDD and the reference power supply Vref may be set to the same.

Figure 6:
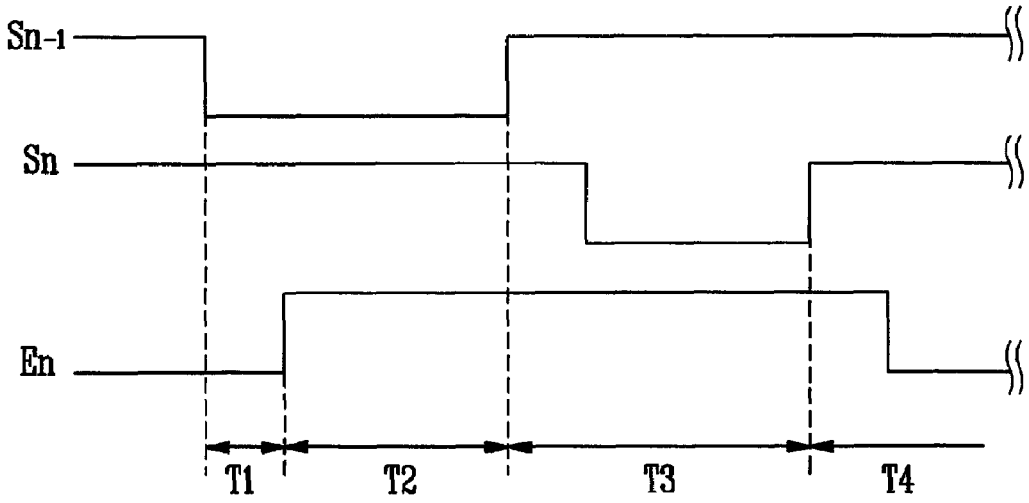
FIG. 6 is a waveform diagram showing the driving method of the pixel of FIG. 5.

FIG. 6 is a waveform diagram showing a driving method of the pixel of FIG. 5 according to one embodiment of the present invention.

Referring to FIG. 6, during a first period T1, which is a partial period of a period when the scan signal is supplied to the (n−1)th scan line Sn−1, the fifth transistor M5 maintains a turn-on state. The third transistor M3 and the fourth transistor M4 are turned on during the first period T1.

If the third transistor M3 is turned on, the gate electrode of the second transistor M2 is coupled electrically to the OLED via the third transistor M3. Therefore, the voltage of the gate electrode of the second transistor M2, which is the voltage of the second node N2, is initialized substantially to the voltage of the second power supply ELVSS. In other words, the first period T1, which is the partial period of the period when the scan signal is supplied to the (n−1)th scan line Sn−1, is used for initializing the voltage of the second node N2.

Thereafter, during a second period T2 other than the first period T1 of the period when the scan signal is supplied to the (n−1)th scan line Sn−1, the fifth transistor M5 is turned off by the light emitting control signal supplied to the n-th light emitting control line En. Then, the voltage value obtained by subtracting the threshold voltage of the second transistor M2 from the first power ELVDD is applied to the gate electrode of the second transistor M2 connected in a diode configuration by the third transistor M3.

The first node N1 is set to the voltage of the reference power supply Vref by the fourth transistor M4 that maintains a turn-on state during the second period T2. Here, assuming that the voltage value of the reference power supply Vref is the same as that of the first power supply ELVDD, the second capacitor C2 is charged with the voltage corresponding to the threshold voltage of the second transistor M2. If a voltage drop voltage is generated in the first power supply ELVDD, the second capacitor C2 is charged with the threshold voltage of the second transistor M2 and the voltage drop voltage of the first power supply ELVDD. In other words, the second capacitor C2 is charged with the voltage drop voltage of the first power supply ELVDD and the threshold voltage of the second transistor M2, thereby making it possible to concurrently compensate for the voltage drop of the first power supply ELVDD and the threshold voltage of the second transistor M2.

Thereafter, during a third period T3, the scan signal is supplied to the n-th scan line Sn. If the scan signal is supplied to the n-th scan line Sn, the first transistor M1 is turned on. If the first transistor M1 is turned on, the data signal is supplied to the first node N1 and thus, the voltage of the first node N1 is dropped to the voltage of the data signal from the reference power Vref. Then, during the third period T3, the voltage of the second node N2 set in a floating state is also dropped by an amount corresponding to the voltage drop of the first node N1. In other words, during the third period T3, the voltage charged in the second capacitor C2 is maintained stably. Here, during the third period T3, the first capacitor C1 is charged with a voltage (e.g., a predetermined voltage) corresponding to the data signal applied to the first node N1.

Thereafter, during a fourth period, the supply of the light emitting control signal to the n-th light emitting control line En is stopped after the supply of the scan signal to the n-th scan line is stopped. If the supply of the light emitting control signal is stopped, the fifth transistor M5 is turned on. If the fifth transistor M5 is turned on, the second transistor M2 supplies a current (e.g., a predetermined current) to the OLED corresponding to the voltage charged in the first capacitor C1 and the second capacitor C2 so that light having a brightness (e.g., a predetermined brightness) is generated from the OLED.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device comprising:

a scan driver for driving scan lines and light emitting control lines;

a data driver for selecting any one gamma voltage of a plurality of gamma voltages corresponding to bit values of externally supplied data and generating data signals;

a pixel coupled to a reference power, a first power, and a second power, the pixel configured to compensate for a voltage drop of the first power using the reference power; and a gamma voltage controller for comparing a voltage value of the reference power with that of a comparative power having a target voltage value of the reference power to generate a comparison result and controlling voltage values of the gamma voltages in accordance with the comparison result, wherein the gamma voltage controller comprises:

a gamma unit for generating the gamma voltages;

at least one comparator for comparing the voltage of the reference power with that of the comparative power;

a subtractor for obtaining a voltage difference between the reference power and the comparative power in accordance with a comparison result of the at least one comparator; and a controller for controlling the gamma unit in accordance with the comparison result of the at least one comparator and the voltage difference.

2. The organic light emitting display device as claimed in claim 1, wherein the gamma voltage controller is configured to control the voltage values of the gamma voltages so that a voltage variation of the reference power is compensated for in accordance with a voltage difference between the reference power and the comparative power.

3. The organic light emitting display device as claimed in claim 1, wherein the at least one comparator comprises:

a first comparator for generating a first control signal when the voltage of the reference power is higher than the voltage of the comparative power, and generating a second control signal when the voltage of the reference power is lower than the voltage of the comparative power; and a second comparator for generating a third control signal when the voltage of the reference power is substantially the same as that of the comparative power.

4. The organic light emitting display device as claimed in claim 3, wherein the controller is configured to control the gamma unit so that the voltages of the gamma voltages are not changed when the third control signal is input.

5. The organic light emitting display device as claimed in claim 3, wherein the controller is configured to control the gamma unit to output the gamma voltages that compensate for a voltage variation of the reference power in accordance with the voltage difference when the first control signal or the second control signal is input.

6. The organic light emitting display device as claimed in claim 1, further comprising:

an analog-digital converter positioned between the subtractor and the controller and configured to convert an analog signal corresponding to the voltage difference supplied from the subtractor into a digital signal and transfer the digital signal to the controller.

7. An organic light emitting display device comprising:

a scan driver for driving scan lines and light emitting control lines;

a data driver for driving data lines with data in accordance with selected gamma voltages;

a pixel for receiving a reference power, a first power, and a second power, the pixel configured to compensate for a voltage drop of the first power using the reference power; and a gamma voltage controller for controlling voltage values of the gamma voltages in accordance with a voltage variation of the reference power from a target voltage, wherein the gamma voltage controller comprises:

a gamma unit for generating the gamma voltages;

at least one comparator for comparing the voltage of the reference power with that of the target voltage;

a subtractor for obtaining a voltage difference between the reference power and the target voltage in accordance with a comparison result of the at least one comparator; and a controller for controlling the gamma unit in accordance with the comparison result of the at least one comparator and the voltage difference.

8. The organic light emitting display device as claimed in claim 7, wherein the gamma voltage controller is configured to compare a voltage value of the reference power with that of a comparative power having the target voltage and to control the voltage values of the gamma voltages in accordance with the comparison result.

* * * * *